United States Patent [19]

Vogt

[11] 4,223,886

[45] Sep. 23, 1980

[54] REGISTRATION GATE MECHANISM FOR RECIRCULATING DOCUMENT FEEDER AND DOCUMENT POSITIONER

[75] Inventor: Walter D. Vogt, Rochester, N.Y.

[73] Assignee: Eastman Kodak Company, Rochester, N.Y.

[21] Appl. No.: 30,482

[22] Filed: Apr. 16, 1979

[51] Int. Cl.[3] ..... B65H 9/06

[52] U.S. Cl. ..... 271/246; 271/DIG. 9

[58] Field of Search ..... 271/3, 245-247, 271/DIG. 9

[56] References Cited

U.S. PATENT DOCUMENTS

| | | | |
|---|---|---|---|
| 2,288,287 | 6/1942 | Kokay . | |
| 3,761,075 | 9/1973 | Namen | 271/DIG. 9 |
| 4,019,732 | 4/1977 | Hunt et al. | 271/245 |
| 4,019,733 | 4/1977 | Mantalto | 271/245 |

OTHER PUBLICATIONS

Research Disclosure Bulletin; vol. 173, Publication No. 17322, pp. 40-43; Sep. 1978, "Apparatus for Registering and Feeding Documents", disclosed by Gustafson, published by Industrial Opportunities Ltd., Homewell, Havant, Hampshire, PO9 IEF, United Kingdom.

Research Disclosure Bulletin, vol. 173, Publication No. 17351, pp. 44-48, Sep. 1978, "Sheet Feeding Apparatus for Use with Copier/Duplicators or the Like", disclosed by Holzhauser et al, published by Industrial Opportunities Ltd.

Research Disclosure Bulletin, vol. 173, Publication No. 17361, pp. 58-61, Sep. 1978, "Apparatus for Selective Copying Documents from Two Different Document Feeders, disclosed by Hage, published by Industrial Opportunities Ltd.

*Primary Examiner*—Robert W. Saifer

*Attorney, Agent, or Firm*—G. Herman Childress

[57] ABSTRACT

A sheet registration mechanism aligns a sheet along a sheet path prior to feeding of the sheet to an exposure position of a copier/duplicator. The mechanism can selecitvely latch a registration member in either of three positions. In one position the registration member aligns the sheet. In second and third positions the registration member is remote from the sheet path to allow sheets to move in two opposite directions along the sheet path.

8 Claims, 11 Drawing Figures

FIG. 3
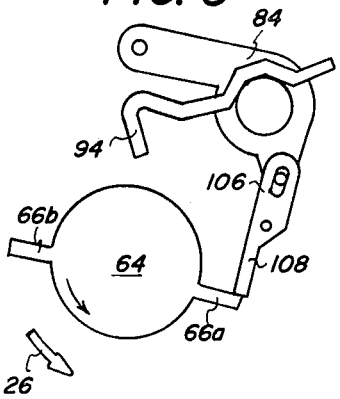
FIG. 4
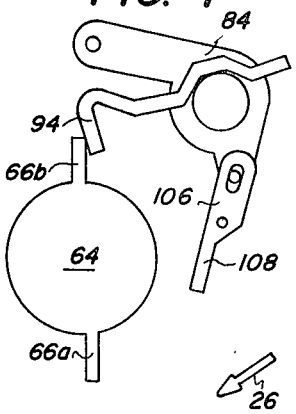
FIG. 5
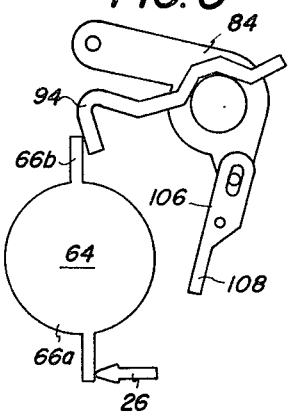
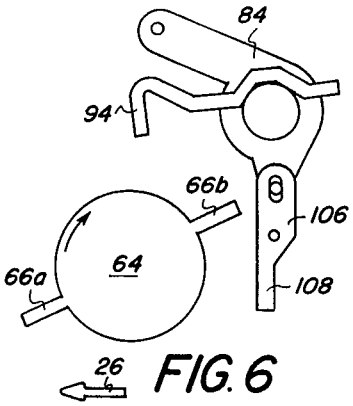
FIG. 6
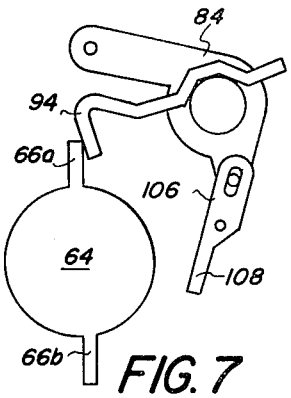
FIG. 7
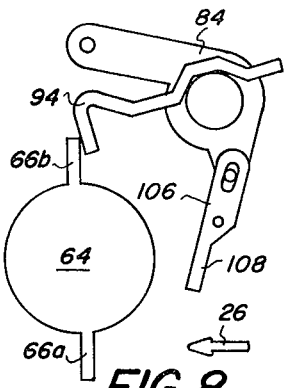
FIG. 8
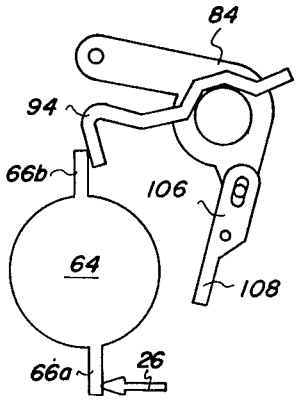
FIG. 9
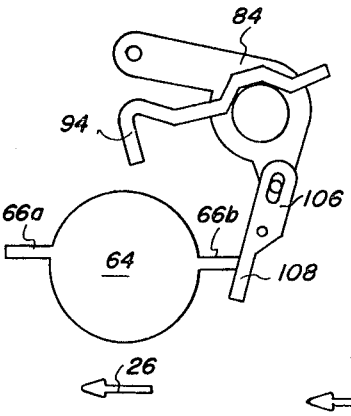
FIG. 10
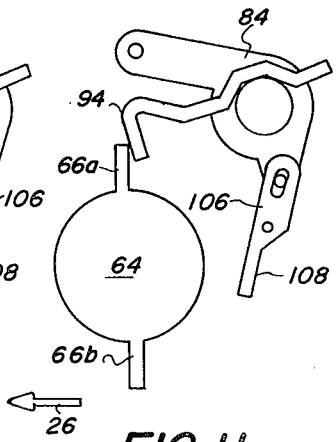
FIG. 11

REGISTRATION GATE MECHANISM FOR RECIRCULATING DOCUMENT FEEDER AND DOCUMENT POSITIONER

FIELD OF THE INVENTION

This invention relates to registration gate mechanisms, and especially to such a mechanism suitable for use in a combination recirculating document feeder and document positioner wherein document sheets are moved in opposite directions past the gate mechanism.

DESCRIPTION OF THE PRIOR ART

Various types of sheet registration mechanisms are well known in the art. U.S. Pat. Nos. 4,109,732 and 4,019,733, both of which issued on Apr. 26, 1977 and are entitled SHEET REGISTRATION MECHANISM, disclose mechanisms for registering a copy sheet in a copier. The mechanisms described in such patents comprise a disc having a pair of oppositely disposed registration fingers which are alternately movable into and out of a position extending across a sheet path. The sheet is driven into engagement with the finger in the sheet path to register the sheet, and at the appropriate time in the copier cycle of operation the finger is moved out of the path to allow the advancement of the sheet away from the registration finger and toward a moving photoconductor where an image is transferred to the copy sheet.

Copending, commonly assigned U.S. patent application Ser. No. 924,040 entitled APPARATUS FOR REGISTERING AND FEEDING DOCUMENTS, filed on July 12, 1978 in the name of G. B. Gustafson, now abandoned, discloses a modified registration apparatus for document sheets wherein a single projecting finger is moved to, and can be held in, either of two positions. In one position the finger registers a document sheet being fed to a platen for copying. In a second position it allows relatively long sheets of paper, such as computer printout, to be fed continuously to the copying position. A related disclosure is found in Publication No. 17,322 which appears at pages 40–43 of Research Disclosure Bulletin, Vol. 173, published in September, 1978 and available from Industrial Opportunities Ltd., Homewell, Havant, Hampshire, PO9 1EF, United Kingdom.

U.S. Pat. No. 2,288,287 entitled SHEET POSITIONING MEANS which issued on June 30, 1942 in the name of S. Kokay discloses a pair of feed rollers that are positioned ahead of a pressure roller and a drum in a duplicating machine. A copy sheet fed from a stack of sheets is directed by guides against a stop positioned ahead of the feed rollers. When the stop is released the sheet is driven by the feed rollers into the nip between the pressure roller and the drum.

It is also known to provide a combination recirculating document feeder and a document positioner wherein one gate mechanism is located at an exposure position of a copier and registers the sheets for copying, and a second gate mechanism is provided for preregistration of document sheets to be fed to the platen by means of the document positioner. Such apparatus is disclosed, for example, in U.S. Pat. No. 4,176,945 which issued on Dec. 4, 1979 from copending U.S. patent application Ser. No. 923,874 entitled SHEET FEEDING APPARATUS FOR USE WITH COPIER/DUPLICATORS OR THE LIKE, filed July 12, 1978 in the names of R. C. Holzhauser et al, and in a related Research Disclosure Publication No. 17,351 which appears at pages 44–48 of Vol. 173 of the Research Disclosure Bulletin referred to hereinbefore. Another such disclosure is found in commonly assigned copending U.S. patent application Ser. No. 924,106 entitled APPARATUS FOR SELECTIVELY COPYING DOCUMENTS FROM TWO DIFFERENT DOCUMENT FEEDERS, filed July 12, 1978 now U.S. Pat. No. 4,192,607 in the name of C. T. Hage and in the related Research Disclosure Publication No. 17,361 which appears at pages 58–61 of Volume 173 of the Research Disclosure Bulletin mentioned hereinbefore.

Generally speaking, the registration mechanisms of the prior art as discussed hereinbefore are concerned only with sheets passing in one direction through the mechanisms. When sheets are to pass in both directions new problems are encountered, and the mechanisms must be especially adapted for that purpose.

SUMMARY OF THE INVENTION

In accordance with the invention a sheet registration mechanism comprises means defining a sheet path. Drive means are provided for advancing sheets in first and second opposite directions along the path. A registration member is mounted for movement between (1) a first position wherein the member is located with respect to the path to be engaged by a sheet (2) a second position wherein the member is located with respect to the path to allow advancement of sheets in the first direction along the path, and (3) a third position wherein the member is located with respect to the path to allow advancement of sheets in the second direction along the path. A latching mechanism releasably holds the registration member in its first, second and third positions.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIGS. 3–7 are views of certain portions of the apparatus illustrating the operation of the gate mechanism when duplex document sheets are being fed along a path from the recirculating feeder to the exposure position at the copier platen; and FIGS. 8–11 are views similar to FIGS. 3–7 but illustrating operation of the gate mechanism when sheets are being fed by the document positioner toward the copier platen.

DESCRIPTION OF THE PREFERRED EMBODIMENT

Figure 1:
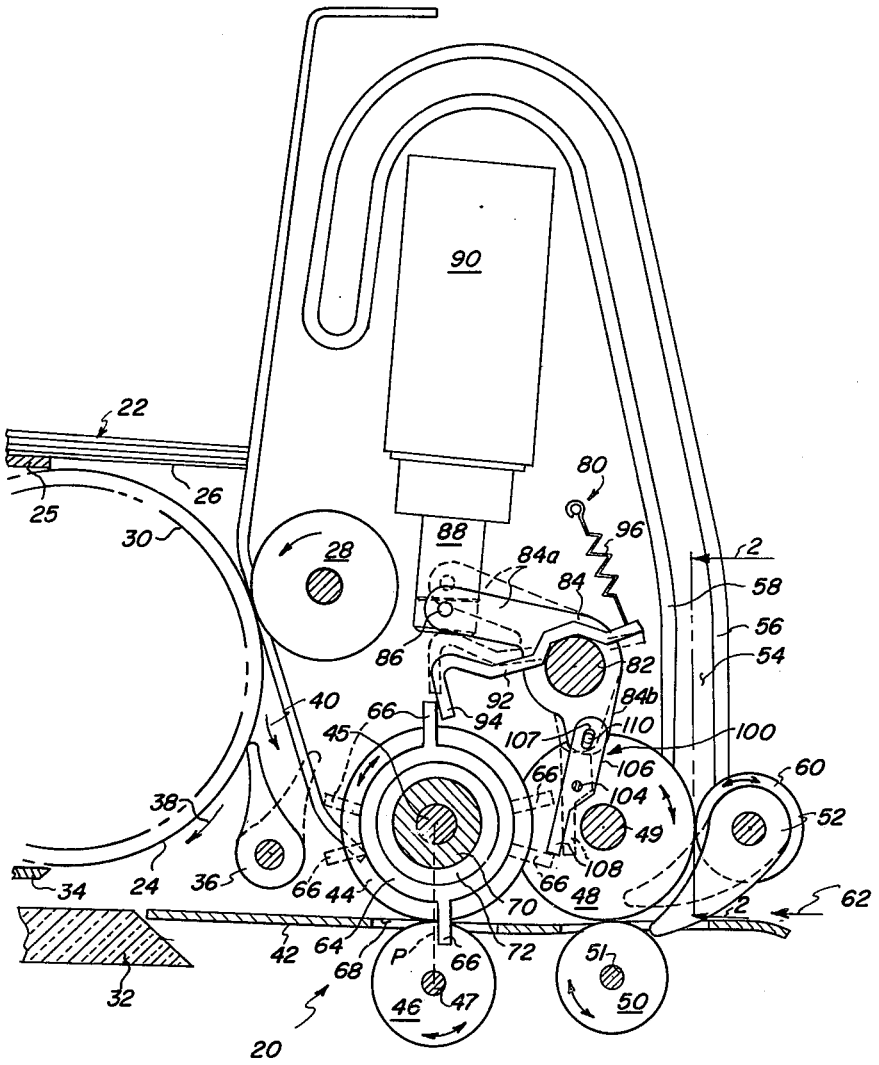
FIG. 1 is a view, partially in elevation and partially in section, illustrating a preferred embodiment of a registration gate mechanism of the present invention.
Figure 2:
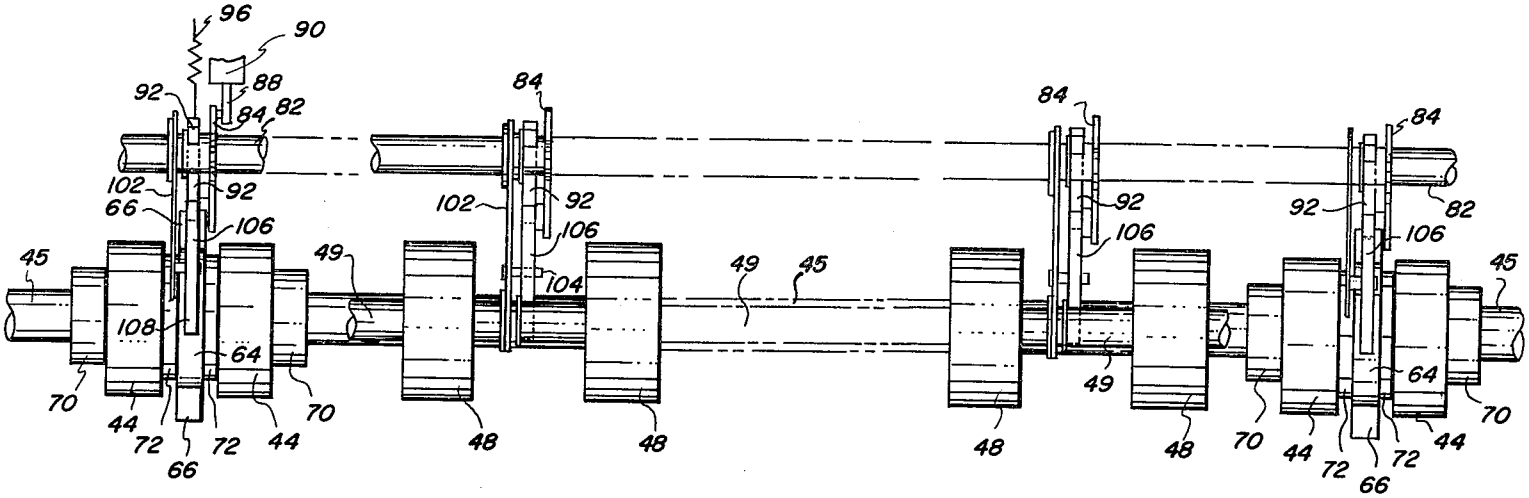
FIG. 2 is an enlarged fragmentary elevation taken from the right side of FIG. 1 and generally along the line 2—2 of FIG. 1.

Referring now to FIGS. 1 and 2 of the drawings in detail, a registration gate mechanism of the present invention is generally designated 20 and is particularly suitable for use with a combination recirculating document feeder and document positioner shown generally at 22. A portion of the feeder and positioner are illustrated in the drawings, and reference is made to the before-mentioned Research Disclosure Publications Number 17,351 and 17,361 for a more complete disclosure of a combination feeder and positioner. Generally, the portion of the recirculating feeder shown includes an oscillating vacuum tube 24 which is located beneath a tray 25. The tray receives a stack of document sheets 26 that are to be copied. The vacuum tube 24 removes the bottom sheet 26 from the stack of sheets and delivers it into the nip between a drive roller 28 and a ring 30 positioned around the vacuum tube 24. The removed sheet is fed to an exposure station, such as onto a transparent copier platen 32, at which it is illuminated and reproduced by the copier. The sheet is received into a space between the platen 32 and a bottom plate 34 of the recirculating feeder.

In some instances document sheets 26 are to be inverted and fed directly to the platen 32. In other instances the sheets are to be fed along a noninverting sheet path, registered by the mechanism of the invention, and then delivered to the platen 32. For example, when document sheets 26 have information to be copied on only the upper face thereof (i.e., simplex document sheets) then the removed sheet is inverted once and fed directly to platen 32 so that the information to be copied faces down on the platen. This is accomplished by moving a sheet deflector 36 from its solid line position to its dotted line position so that the removed sheet is deflected and driven along a sheet path shown by the arrow 38 toward the platen 32 and into the space between the platen and the bottom plate 34 of the recirculating feeder. When document sheets 26 have information on both faces thereof that is to be copied (i.e., duplex document sheets) then deflector 36 is located in its solid line position and a removed sheet is fed into a noninverting sheet path as shown by the arrow 40.

A sheet traveling along path 40 engages a sheet guide 42 and is delivered into the nip between a plurality of sheet drive rollers 44 located above guide 42 and idler rollers 46 located beneath the guide 42. Rollers 44 are mounted on a shaft and arranged in pairs as shown in FIG. 2 and described in more detail later. Rollers 46 are mounted on a shaft 47 and one roller 46 is located beneath each roller 44. Rollers 44 and 46 can be driven in either of two opposite directions as indicated by the arrows in FIG. 1. By driving rollers 44 in a counterclockwise direction as viewed in FIG. 1 the sheets are driven between rollers 44 and 46 and into the nip between a plurality of drive rollers 48 located above guide 42 and idler rollers 50 located beneath the guide 42. Rollers 48 and 50 are mounted on shafts 49 and 51, respectively. Rollers 48 and 50 also can be driven in opposite directions, as indicated by the arrows, and initially are driven in a counterclockwise direction so that a sheet delivered into the nip between the rollers is fed to the right through the nip.

The sheet passing between rollers 48 and 50 engages a sheet deflector 52, which is then located in its solid line position to deflect the sheet upwardly into a guide slot 54 defined by spaced guide members 56 and 58. As the sheet is deflected upwardly by deflector 52 it passes between the drive rollers 48 and a plurality of idler rollers 60. The drive to rollers 44 and 48 is stopped after the trailing edge of the sheet passes between rollers 44 and 46 and before the trailing edge passes between rollers 48 and 60. Then the rollers 44 and 48 are driven in the opposite direction (the clockwise direction) to drive the sheet from the noninverting sheet path in the slot 54. The sheet travels back through the nip between rollers 48 and 50, then through the nip between rollers 44 and 46 (after registration of the sheet as explained later), and then onto the platen 32 and into the space between the platen and the plate 34.

When sheets are to be fed to the platen by the document positioner structure, the sheet deflector 52 is moved to the dotted line position illustrated in FIG. 1 and sheets are manually advanced along the guide 42 and into the nip between drive rollers 48 and idler rollers 50 along a path shown by the arrow 62. At this time drive rollers 44 and 48 are rotating in a clockwise direction so that the sheet is driven by rollers 48 and 50 into the nip between rollers 44 and 46 (after registration of the sheet as explained later) and then advanced by rollers 44 and 46 along guide 42 into the space between the platen 32 and the plate 34.

The apparatus of the invention registers sheets being fed toward the platen from slot 54 or from the document positioner along path 62. The registration apparatus includes a plurality of registration or gate rollers 64 which are positioned along the shaft 45. Each of the rollers 64 has a pair of gate pins 66 that project from diametrically opposite portions of the rollers. The diameter of each of the rollers 64 is such that it is positioned above guide 42 and spaced from sheets traveling along the guide under control of the rollers 44. However, the pins 66 project from the rollers by a distance such that they can extend through a hole 68 in guide 42 and beneath the surface thereof as illustrated in FIG. 1. In this position they extend across the sheet path and are engageable by a sheet being advanced by drive rollers 48 toward the rollers 44 to register the sheet.

One manner in which the gate rollers 64 can be mounted on shaft 45 and frictionally driven by means of a tendency drive from the drive rollers 44 is described in detail in the beforementioned U.S. Pat. Nos. 4,019,732 and 4,019,733 and in the beforementioned Research Disclosure Publication No. 17,322. Generally, the rollers 64 are loosely positioned around hubs 70 which are secured to the shaft 45 for rotation therewith. Each hub 70 extends a substantial distance along the shaft 45 as best illustrated in FIG. 2. A pair of the drive rollers 44 are positioned around each hub 70 and are secured thereto so that upon rotation of the shaft 45 all of the pairs of drive rollers 44 are rotated with the shaft and the hubs 70. One of the gate rollers 64 is located between each pair of drive rollers 44 and is frictionally coupled thereto by means of a pair of thrust washers 72, one of which is positioned between each of the drive rollers 44 and the adjacent side of the gate roller 64. The drive rollers 44 are secured to the hub in a position to urge the thrust washers firmly against the gate rollers. Due to the frictional contact between rollers 44, washers 72 and gate rollers 64 there is a tendency for the gate rollers to rotate with the hub.

However, the frictional drive between the drive rollers and the gate rollers can be overcome by latching or holding the rollers 64 against rotation as, for example, by a latching force applied against the registration pins 66 as explained in more detail later. Thus it will be seen that the gate rollers are frictionally driven by this tendency drive and are urged in the same direction of rotation as the drive rollers 44. A reversal in the direction of rotation of rollers 44 also results in a reversal in the direction the gate rollers tend to rotate.

A latching mechanism shown generally at 80 is used for holding the gate pins 66 in either one of three different positions for the various modes of operation of the apparatus of this invention. Latching mechanism 80 comprises a shaft 82 located generally above the drive rollers 48. Along the shaft 82 is a bell crank lever 84 for each gate roller 64. Each lever 84 has two arm portions 84*a* and 84*b* that extend from the shaft 82 at an included angle of about 120° to 130°. The end portion of arm 84*a* opposite from shaft 82 of one of the levers is connected by a pin 86 to an armature 88 of a solenoid 90. When the solenoid is energized the armature is retracted to effect movement of the lever 84 from its solid line position to its dotted line position, thereby rotating the shaft 82 a few degrees in a clockwise direction.

Secured to the shaft 82 are a plurality of latching members 92, each of which has at its end a finger 94. Members 92 are movable with shaft 82 in response to energization of the solenoid 90. Each member 92 moves from its solid line position to its dotted line position as shown in FIG. 1. In the solid line position each finger 94 is positioned to be engaged by, and to hold, a gate pin 66 that is being urged in a clockwise direction. When in its dotted line position each finger is out of the way of the pins 66 to allow rotation of the pins and the gate rollers 64 with the rollers 44.

A spring 96 has end portions connected to a suitable support and to the end of one of the latching members 92 opposite from the finger 94. The force exerted by spring 96 urges the associated member 92 and thus the shaft 82 in a counterclockwise direction. As a result all of the members 92 and fingers 94 are urged toward their respective solid line (latching) position. Lever 84 also is urged in a counterclockwise direction. Thus when the solenoid 90 is de-energized the lever returns to its solid line position and the shaft 82 moves a few degrees in a counterclockwise direction due to the urging of spring 96. Thus it will be understood that while one of the latching members 92 is provided for each gate roller 64, only a single spring 96 is required to provide the return movement of the latch members and shaft 82 described hereinbefore.

For each gate roller 64 there is provided a stop mechanism 100 for holding the attached gate pins 66 in each of the two positions illustrated in phantom in FIG. 1. One stop mechanism will be described in detail, it being understood that the others are identical in construction. As shown in FIGS. 1 and 2, each stop mechanism 100 comprises a plate 102 which is mounted by suitable bearings onto the shafts 49 and 82. A pin 104 carried by each plate 102 projects through a central portion of a latch member 106. The upper end of the latch member 106 has an elongate slot 107 which receives a pin 110 on arm portion 84*b* of the bell crank lever 84. The lower end of the latch member 106 has a latching finger 108 which is moved between its solid line position and its dotted line position in response to energization and de-energization of the solenoid 90, the oscillating movement being transmitted through lever 84, pin 110 and slot 107 of the latch member.

When the latch finger 108 is in the solid line position as shown in FIG. 1 it is engageable by the gate pins 66 when they rotate in both a clockwise and counterclockwise direction. When the latch finger is in this position and the gate pins are urged in a counterclockwise direction the pins hit the lower end of the latch finger. When the gate pins are being rotated in a clockwise direction then the pins hit the latch finger at a position slightly below the pin 104 so that the left side surface of the latch finger stops and holds the pins 66.

The operation of the registration gate mechanism of the invention will now be described. In describing the operation reference will be made to FIGS. 3–11 which diagramatically illustrate certain parts of the mechanism during various stages in the operation. In order to simplify the explanation of the operation, the two gate pins 66 for each roller 64 have been designated 66*a* and 66*b* in FIGS. 3–11. Also, in FIGS. 3–11 the location and direction of movement of a document sheet is indicated by the arrow 26.

Initially, feeding of duplex document sheets 26 will be described with reference to FIGS. 1–7. Deflectors 36 and 52 are moved to their respective solid line positions. A sheet 26 is removed from the stack of sheets in the tray of the recirculating feeder by means of the oscillating vacuum feeder 24. The sheet is advanced along path 40 by rollers 28 as shown in FIG. 1 and illustrated by arrow 26 in FIG. 3. At this time drive rollers 44 are rotated in a counterclockwise direction, and this causes the gate rollers 64 to be urged into rotation in a counterclockwise direction. Each pin 66*a* was initially located in the registration position (shown in solid line in FIG. 1), and it is moved with the associated gate roller 64 until it engages the lowermost end of the related finger 108. The fingers holds the pins 66*a*, and thus the gate rollers 64, against further rotation even though the frictional connection between the gate rollers 64 and the drive roller 44 allow the drive rollers to continue to rotate. Thus the pins 66 are held out of the sheet path while the sheet is driven along path 40 and up into the guide slot 54 by rollers 44, 46, 48, 50 and 60.

After the trailing edge of the sheet passes the gate area, rollers 44 and 48 are reversed (or driven in a clockwise direction) to drive the sheet toward the platen 32. The gate rollers 64 also are initially driven in a clockwise direction by the frictional connection between the gate rollers and the drive rollers 44. This movement continues until each of the registration pins 66*b* strikes the associated finger 94 as shown in FIG. 4. Fingers 94 then hold the gate rollers against further rotational movement. In this position, the pin 66*a* projects into the opening or slot 68 in the sheet guide 42 and across the path that must be traveled by the sheet as it returns from slot 54 toward the platen. As will be observed from FIGS. 1 and 4, fingers 94 hold the pins 66*a* in a position slightly offset (to the right) from an imaginary plane P that passes through the axis of shafts 45 and 47 and through the nip between rollers 44 and 46. Therefore, the sheet engages the pins 66*a* and is registered prior to the time the leading edges of the sheet enters the nip between rollers 44 and 46. This is the position shown for the sheet 26 in FIG. 5.

At the appropriate time in the machine cycle solenoid 90 is energized to retract armature 88 and thereby move the bellcrank lever 84 attached to the armature to its dotted line position. This in turn rotates shaft 82 and the other levers 84 to move the latching members 92 and fingers 94 to their dotted line position and simultaneously pivots the latch members 106 to their dotted line position. When the solenoid is energized, the gate pins 66 are released by finger 94 and the gate rollers 64 begin rotating in a clockwise direction with the drive rollers 44. This allows the sheet to travel past the gate pins as shown in FIG. 6.

The solenoid 90 remains energized for a sufficient period of time to allow the gate pins 66*b* to clear the latch members 106. Then the solenoid is de-energized and spring 96 returns the bellcranks 84 and latch members 92 and 106 to their normal position. Then the gate pins 66*a* strike the latch fingers 94 as shown in FIG. 7 and the fingers temporarily hold the gate rollers against rotation.

Thus in a typical cycle of operation the gate pins 66 start at an initial vertical position in the sheet path and move counterclockwise by less than 90° where they are held out of the sheet path by latch finger 108 until the sheet enters slot 54. Next the pins are returned to the vertical position where they are held by fingers 94 until registration of the sheet is accomplished. Then when released by the fingers 94 the gate pins rotate clockwise out of the sheet path again to permit advancement of the sheet. At this time in the cycle the gate pins rotate 180° to the FIG. 7 position wherein the gate pins 66*a* are again held by fingers 94. Depending upon the length of the sheet 26, gate pins 66*b* may engage and rest on the sheet until the trailing edge of the sheet passes pins 66*b*. This engagement can occur without damage to the sheet becuase the gate rollers 64 are driven by a friction or tendency drive as previously described and as set forth in more detail in the beforementioned commonly assigned U.S. Pat. Nos. 4,019,732 and 4,019,733.

FIGS. 1, 2 and 8–11 illustrate the operation of the apparatus for registering a document sheet fed along path 62 of the document positioner apparatus. Initially, the pins 66*a* are located in the registration position and the pins 66*b* are held by the fingers 94 against rotation in a clockwise direction as shown in FIGS. 1 and 8. The sheet 26 is fed manually along path 62. The deflector 52 is in its dotted line position so that the sheet is fed into the nip between drive rollers 48 and 50. At this time rollers 48 and 44 are being driven in a clockwise direction so that the sheet is immediately advanced by rollers 48 and 50 against the registration pins 66*a*, as shown in FIG. 9, to register the document sheet.

At the appropriate time in the machine cycle solenoid 90 is energized to retract the armature 88. In this mode of operation the solenoid remains retracted just long enough to allow pins 66*b* to pass the fingers 94 and it is then de-energized. This is a relatively short energization of the solenoid 90 as compared to the previously described mode of operation in which the solenoid remains energized for a longer period of time. By reducing the time the solenoid is energized and by quickly returning the mechanism to its normal position, as illustrated in FIG. 10, by means of spring 96, the latch members 106 are returned to the position illustrated before the gate pins 66*b* rotate 90°. Latch members 106 thus are positioned to be engaged by the gate pins 66*b* to trap the pins after they are released by fingers 94 and before they return to their registration position. Members 106 continue to hold the pins 66*b*, and thus the gate rollers 64, against further rotation until such time as the document sheet is fed past the registration position as shown in FIG. 10. This is desirable because sheets fed along the document positioner may include relatively long document sheets, such as computer fan-fold sheet material which is to be copied in a manner described in the beforementioned Research Disclosure Publication No. 17,322.

After the document sheet has passed beneath the registration rollers 64 as shown in FIG. 11, solenoid 90 is again energized for a brief period of time sufficient to move latch members 106 to their dotted line position. This allows the pins 66*b* to pass the latch members 106. After the solenoid is de-energized fingers 94 return to the position shown in FIG. 11 wherein the fingers 94 are engaged by the registration pins 66*a*. This holds the registration pins 66*b* in the registration position where they can be engaged by another document sheet fed along path 62 of the document positioner.

The second pulse to the solenoid 90 for releasing registration pin 66*b* can occur as a result of a timed cycle or it can be produced by a sensor located along the sheet path. Such a sensor is disclosed in the beforementioned Research Disclosure Publication No. 17,322 wherein it is shown located along a portion of the sheet path between the drive rollers 44 and 48. Such a sensor can also be used for determining when to reverse rollers 44 and 48 in the feeding of duplex sheets.

In summary, in the document positioner mode the registration rollers 64 are initially held in the registration position (FIG. 8) with the pins 66*a* lying across the sheet path, and the document is driven by rollers 48 and 50 into engagement with the pins 66*a* for registration (FIG. 9). Then the solenoid is energized once briefly to release pins 66*b* and allow them to engage and be stopped by latch member 106 while the sheet is driven toward the platen (FIG. 10). Then at a predetermined time in the cycle the solenoid is energized again to release pins 66*b* and allow them to return to the registration position (FIG. 11) where they are held by the fingers 94.

In the various modes of operation of the registration mechanism the various drive rollers can rotate in both directions to move a document sheet received from the oscillating vacuum feeder into slot 54, and then from that slot, or from the document positioner, in the opposite direction toward the platen 32. The registration fingers and latching mechanisms are manipulated in a predetermined sequence which holds the registration fingers in any of several positions as required in order to accomplish the desired registration, to allow movement of the sheets into the slot 54 or to allow movement of the sheets out of the slot or along the document positioner path 62 toward the platen. The various modes of operation can be controlled by a logic and control unit which forms part of a copier/duplicator or the like as is well known in the art.

While the invention has been described in detail with particular reference to a preferred embodiment thereof, it will be understood that variations and modifications can be effected within the spirit and scope of the invention as described hereinabove and defined in the appended claims.

I claim:

1. A sheet registration mechanism comprising:

means defining a sheet path;

drive means for moving sheets in first and second opposite directions along said path;

a registration member mounted for movement between (1) a first position in said path for engaging a sheet being moved along said path by said drive means; (2) a second position remote from said path to allow sheets to move in said first direction along said path; and (3) a third position spaced from said first and second positions and remote from said path to allow sheets to move in said second direction along said path; and latch means for selectively holding said registration member in said first, second, or third positions.

2. The invention as set forth in claim 1 further comprising a second registration member, a roller, said registration members projecting from the circumference of said roller in spaced relation to each other, said roller being rotatable in first and second opposite directions to selectively position each of said members in one of said first, second or third positions, and said latch means being effective to selectively hold said second registration member in said first, second or third positions.

3. The invention as set forth in claim 2 wherein said latch means comprises two fingers, each of said fingers being moveable between (1) a first position wherein the finger is engageable with said registration members to latch said members in one of their first, second or third positions and (2) a second position wherein the finger does not engage said registration members, and means for moving said fingers between their first and second positions.

4. The invention as set forth in claim 3 further comprising means mounting a first one of said fingers for pivotal movement about an axis intermediate its ends, and said moving means comprises a rotatable shaft, a second one of said fingers being secured to said shaft for movement therewith, a lever connected to said shaft and to an end portion of said first one of said fingers so that movement of said lever effects rotation of said shaft and movement of said fingers, a solenoid coupled to said lever for moving said lever in a first direction, and a spring for moving said lever in the opposite direction.

5. A sheet registration mechanism for use with apparatus for feeding document sheets from a recirculating feeder or a document positioner to an exposure position in a copier or the like, the mechanism comprising:

means defining a sheet path leading from the recirculating feeder and the positioner to the exposure position;

a plurality of reversible sheet feeding rollers positioned along said path for feeding sheets along the path in a first direction leading toward the exposure position and a second direction leading away from the exposure position;

a plurality of rotatable gate rollers located adjacent to said sheet path, each of said gate rollers having a pair of registration pins spaced from each other around the periphery of the gate roller and positionable across the path for engagement by the leading edge of a sheet;

friction drive means for urging the gate rollers and the pins in the same rotational direction as the sheet feeding rollers, thereby to move the pins into and out of their position across the path; and latching means for holding the pins against the urging of the friction drive means in (1) a first position wherein one of the pins of each pair of pins is across the path and (2) second and third positions wherein both of the pins of each pair of pins are spaced from the path to allow advancement of sheets in the first and second directions by said sheet feeding rollers.

6. The invention as set forth in claim 5 wherein said sheet feeding rollers comprise a first set of rollers and a second set of rollers, said sets of rollers being spaced from each other along said path and the first set of rollers being nearer to the exposure position than the second set of rollers, and said pins when latched in their first positions being located along the path in a position to be engaged by the leading edge of a sheet between the sets of rollers.

7. The invention as set forth in claim 5 wherein said latching means comprise (1) a first finger engageable with one of the pins of each pair of pins for holding the other of the pins of the pair of pins across the path and (2) a second finger engageable by either of the pins of each pair of pins for holding the pins in their second and third positions.

8. The invention as set forth in claim 7 wherein the latching means further comprises a spring operatively coupled to said fingers for urging the fingers into positions for engagement by the pins, and a solenoid coupled to said fingers and operable when energized to simultaneously move said fingers into positions wherein the pins are released and said gate rollers are free to rotate.

* * * * *